US005672020A

United States Patent [19]

Leonard et al.

[11] Patent Number: 5,672,020

[45] Date of Patent: Sep. 30, 1997

[54] HIGH RESOLUTION COMBINATION DONOR/DIRECT THERMAL PRINTER

[75] Inventors: Benjamin P. Leonard, St. Paul; Eric A. Ware, Plymouth; Marty F. Higgins, Brooklyn Center; Robin L. Ogle, Corcoran; Paul R. Erickson, Prior Lake; Danny J. Vatland, Chanhassen, all of Minn.

[73] Assignee: Lasermaster Corporation, Eden Prairie, Minn.

[21] Appl. No.: 467,840

[22] Filed: Jun. 6, 1995

Related U.S. Application Data

[62] Division of Ser. No. 285,059, Aug. 1, 1994, Pat. No. 5,516,219.

[51] Int. Cl.[6] ..... B41J 29/02

[52] U.S. Cl. ..... 400/690.4; 400/692; 400/636; 347/218

[58] Field of Search ..... 400/613, 630, 400/632, 636, 636.2, 690.4, 691, 692, 662; 347/218, 220; 346/145

[56] References Cited

U.S. PATENT DOCUMENTS

| | | | |
|---|---|---|---|
| 2,632,549 | 3/1953 | Rainey | 400/633 |
| 4,527,174 | 7/1985 | Fujiwata et al. | 400/636 |
| 4,532,524 | 7/1985 | Yana et al. | 400/636 |
| 4,569,611 | 2/1986 | Watanabe et al. . | |
| 4,598,300 | 7/1986 | Ono | 347/218 |
| 4,617,577 | 10/1986 | Takahashi et al. | 400/691 |
| 4,663,638 | 5/1987 | Hirose . | |
| 4,729,681 | 3/1988 | Moser . | |
| 4,775,254 | 10/1988 | Nakao et al. . | |
| 4,947,185 | 8/1990 | Mitsushima et al. | 400/690.4 |
| 5,152,618 | 10/1992 | Goodwin et al. | 400/662 |

FOREIGN PATENT DOCUMENTS

| | | | |
|---|---|---|---|
| 348175 | 10/1989 | European Pat. Off. | 400/636 |
| 0 410 458 A2 | 7/1990 | European Pat. Off. . | |
| 0 530 634 A2 | 8/1992 | European Pat. Off. . | |
| 0 539 156 A3 | 10/1992 | European Pat. Off. . | |
| 43 00 939 A1 | 1/1993 | Germany . | |
| 61-118278 A | 6/1986 | Japan . | |
| 63-051167 | 3/1988 | Japan | 400/692 |
| 1-182078 | 7/1989 | Japan | 400/636 |
| 3-133660 | 6/1991 | Japan | 400/636 |
| 2207887 | 2/1989 | United Kingdom | 400/636 |

*Primary Examiner*—David A. Wiecking
*Attorney, Agent, or Firm*—Finney & Lange

[57] ABSTRACT

A high resolution thermal printer capable of printing both directly on a thermally responsive media and indirectly through a thermally responsive donor media is disclosed. The printer has a printing media guide mounted as an intermediate clamshell structure to accurately position the printing media immediately adjacent the print head and platen. The printing media guide includes a nip roller and guide bar independently suspended on a spring biased, pivot plate arrangement. The printing media is centered on the supply spool, and the printer includes a read/write circuit to communicate with a profiler chip centrally mounted in the printing media roll. The printer may also include a read/write circuit to communicate with a donor profiler chip centrally mounted in the donor media roll. A constant pressure brake with a friction belt is used directly against the printing media. A spring arm latch/channel block arrangement is used to secure the printing media supply spool. An optical sensor and return motor on the supply spool are used in accurately positioning the printing media for subsequent color passes during full color printing.

13 Claims, 7 Drawing Sheets

20
30
34
50
46
26
64
38
40
54
32
42
66
36
68
43
70
78
60
62
48
56
82
92
76
88
94
54
74
104
90
35
86
72
114
28
39
120
84
122
124
126
22
192
24
160
134
142
204
132
200
98
130
196
197
166
152
150
158
162
160
148
202

HIGH RESOLUTION COMBINATION DONOR/DIRECT THERMAL PRINTER

This is a divisional of application Ser. No. 08/285,059, filed Aug. 1, 1994, now U.S. Pat. No. 5,516,219.

BACKGROUND OF THE INVENTION

This invention relates to thermal printers, and more particularly, to a new and improved high resolution thermal printer capable of both donor printing (i.e., the print head heats a thermally responsive donor media to transfer a print image to a receptive printing media) and direct printing (i.e., the print head heats a thermally responsive printing media itself). The new thermal printer of this invention has higher accuracy and resolution of print than possible with previous printers.

Thermal printer have been used in a variety of applications. For instance, thermal printers have been common in the facsimile printing industry for some time. Thermal printers use thermally responsive printing media, that is, printing media which responds to heating above a threshold temperature by changing color. The thermal printing operation generally involves transporting a printing media past a linearly linear array of individual heating elements. By carefully controlling the heating conditions, each heating element can cause rapid coloring of the immediately adjacent portion of printing media if activated, but will no coloring if deactivated. As the printing media passes over the print head, the heating elements are selectively activated and deactivated to create an image.

Donor thermal printers are printers which use a thermally-responsive donor material to print onto the printing media. The donor material may have a wax or ink-based substance which melts when immediately adjacent an activated heating element. The melted wax or ink may then solidify or be absorbed on the printing media to form a dot of an image. Similar to a ribbon on a conventional typewriter, the donor media is generally transported past the print head by a separate transport system.

Thermally responsive media (both direct and donor) is generally monochromatic, making full color thermal printing difficult. Color printing has been performed using four-color donor media. The four-color donor media may have individual segments or panels of the four subtractive primary colors (cyan, yellow, magenta and black—"CYMK"). Color printing in this way requires four separate printing passes of the entire image by the print head, each pass using a different colored donor media panel. In between monochromatic passes, the image on the printing media is reversed past the print head, such that a subsequent pass may print an additional color directly on top of the previous image. Accurate placement of the image is necessary for propel printing of subsequent colors on top of the previous image. In part because of difficulty in accurately aligning the image for subsequent passes, color printing has been performed with thermal printers only for low resolution applications. A more accurate placement system is necessary for color thermal printing with high resolution.

Thermal printers have generally been previously used only for low resolution applications such as 50–100 dots per inch ("dpi"). Because of the low resolution of thermal printers, thermal printers have not been capable of producing clear text and graphics of high image quality, and have been unsuitable for a number of applications requiring higher resolution. In particular, resolutions of 300 dpi or higher are necessary for high image quality graphics. Resolutions in excess of 900 dpi are typically desired for high resolution applications such as printing offset masters to be used on a printing press. Thermal printers have previously been totally unsuitable for such high resolution images.

SUMMARY OF THE INVENTION

The present invention is a high resolution combination donor/direct thermal printer. The printer can print either on thermally responsive paper or with a thermally responsive donor media. The printing media is guided from a supply spool to the platen by a guide bar. The printing media guide structure includes a nip roller to press the printing media against the platen. The guide bar and nip roller have an independent suspension structure which allows them to take parallelism off of the platen, increasing reproducibility of image location. The guide bar and nip roller are part of an intermediate clamshell structure for ease of insertion of the printing media into the printer. The printing media supply spool further includes a self-latching arrangement for ease of inserting and removing the printing media.

The guide bar has guides mounted on either side of the printing media which are moveable to adjust for different widths of printing media. The printer can communicate with a profiler chip centrally mounted in a roll of printing media and/or a profiler chip centrally mounted in a roll of donor media. The printer thus further accommodates printing media and/or donor media of different widths.

A constant drag brake is mounted in friction contact against the printing media, against the exterior surface of the printing media supply spool, further allowing accurate feed of the printing media.

Donor media can be independently fed past the print head on the top portion of a clamshell structure. A separate return motor and optical sensor for the printing media are used to accurately return the image for subsequent passes of the image past the print head.

While the above-identified drawing figures set forth one alternative embodiment, other embodiments of the present invention are also contemplated, some of which are noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENTS

Figure 1:
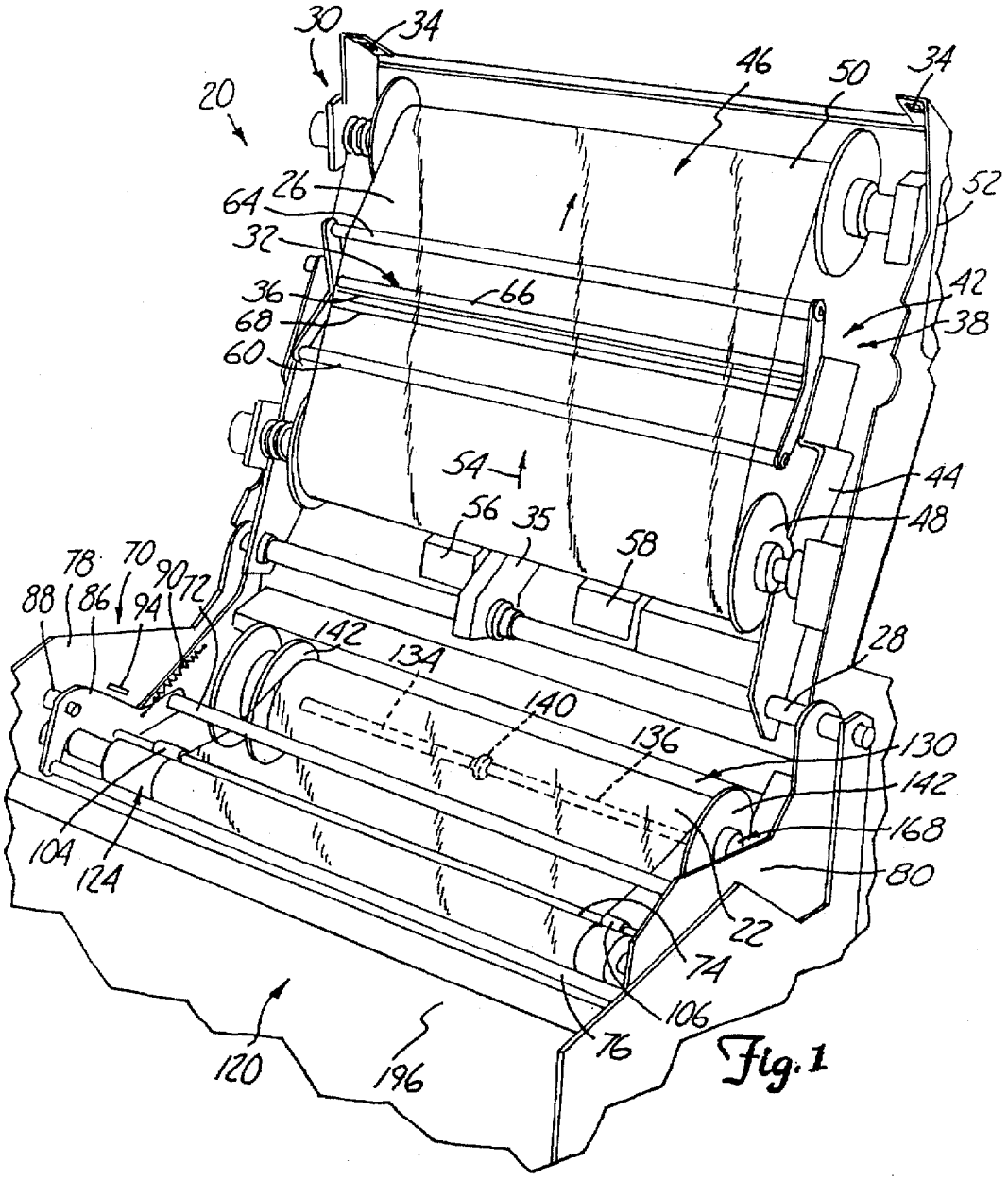
FIG. 1 is a perspective view of the printer of the present invention, with the upper clamshell donor-transport system raised.
Figure 2:
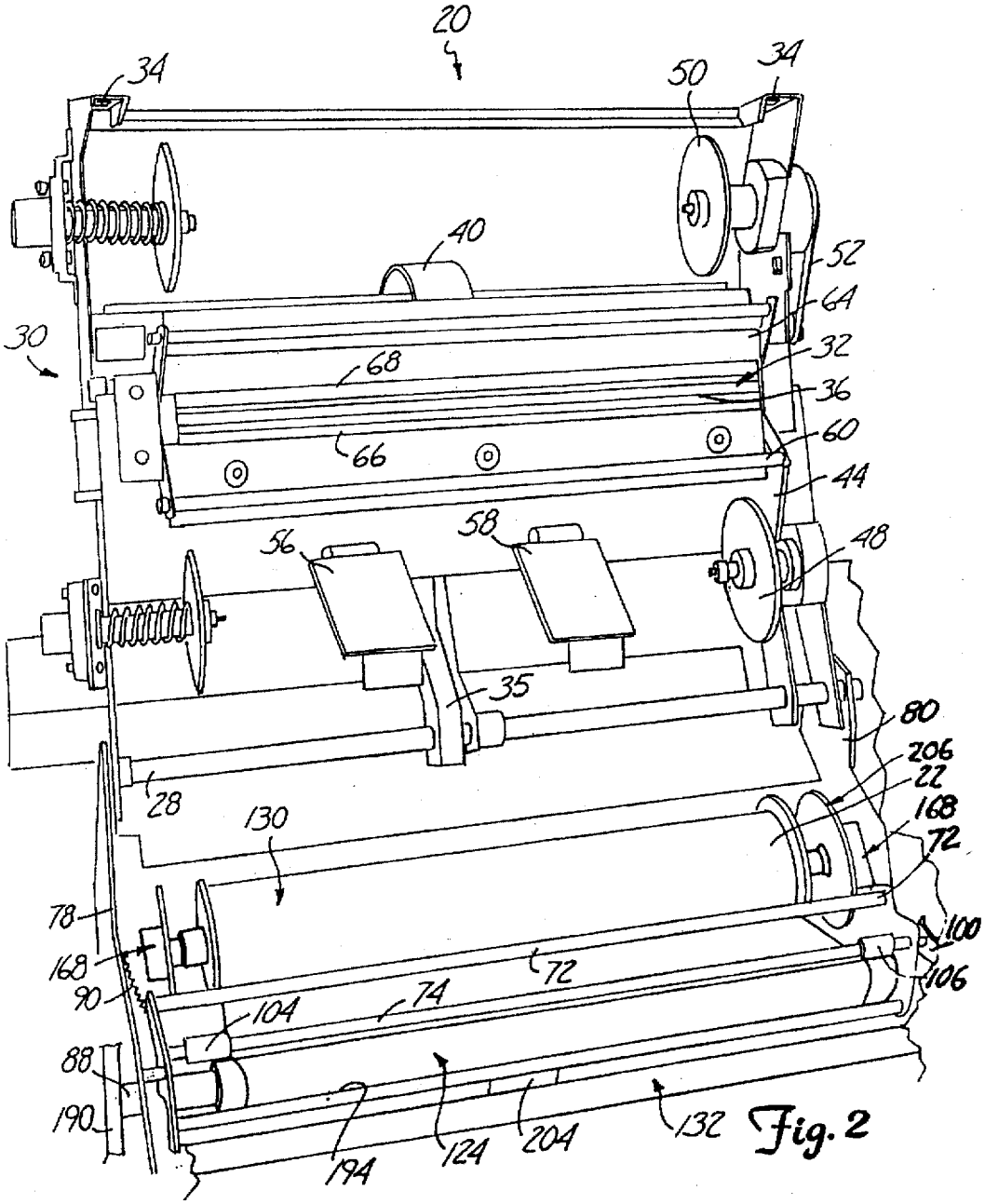
FIG. 2 is a top front view of the printer depicted in FIG. 1.
Figure 3:
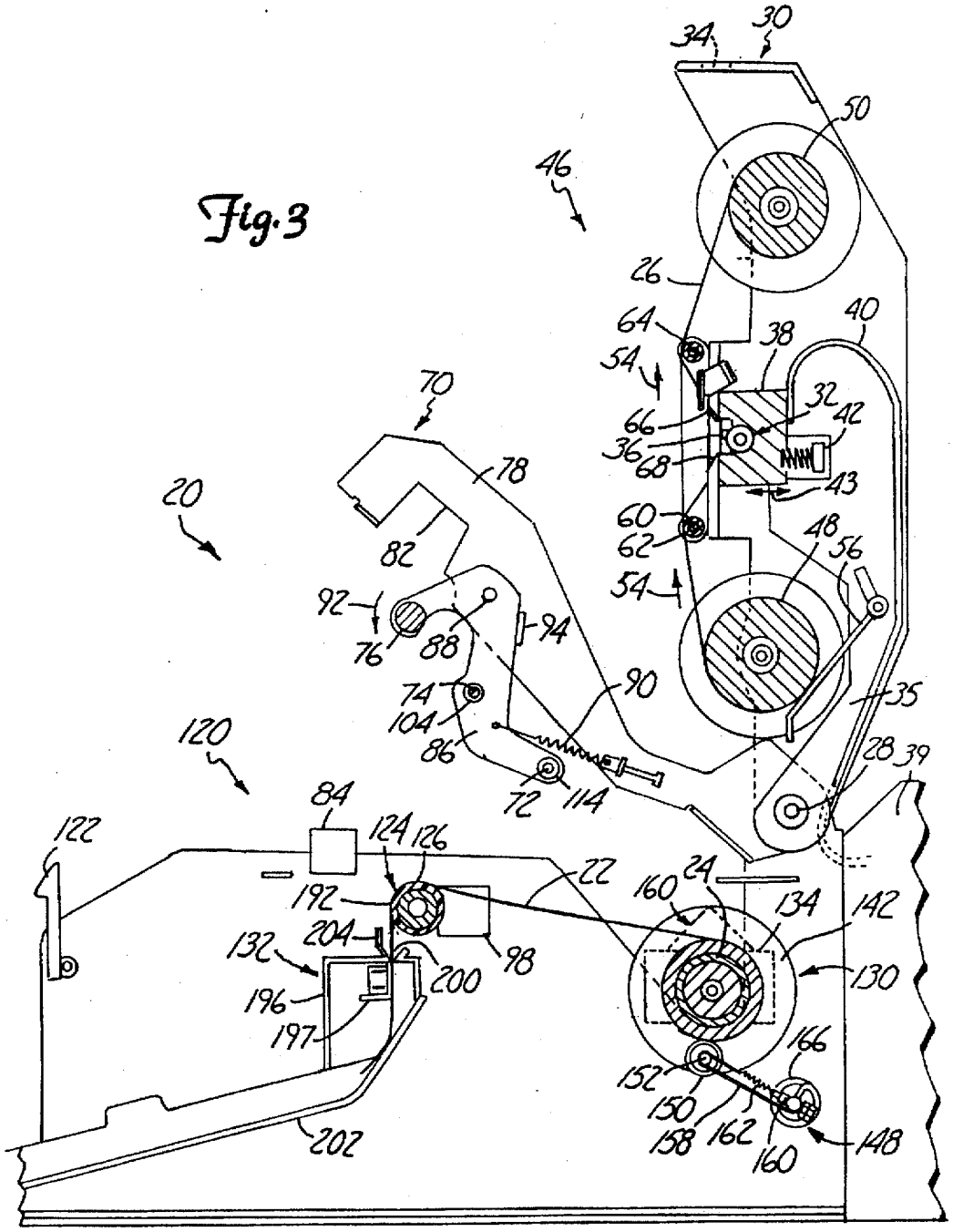
FIG. 3 is a side cross-sectional view of the printer with both the upper clamshell and the intermediate clamshell structures open.
Figure 4:
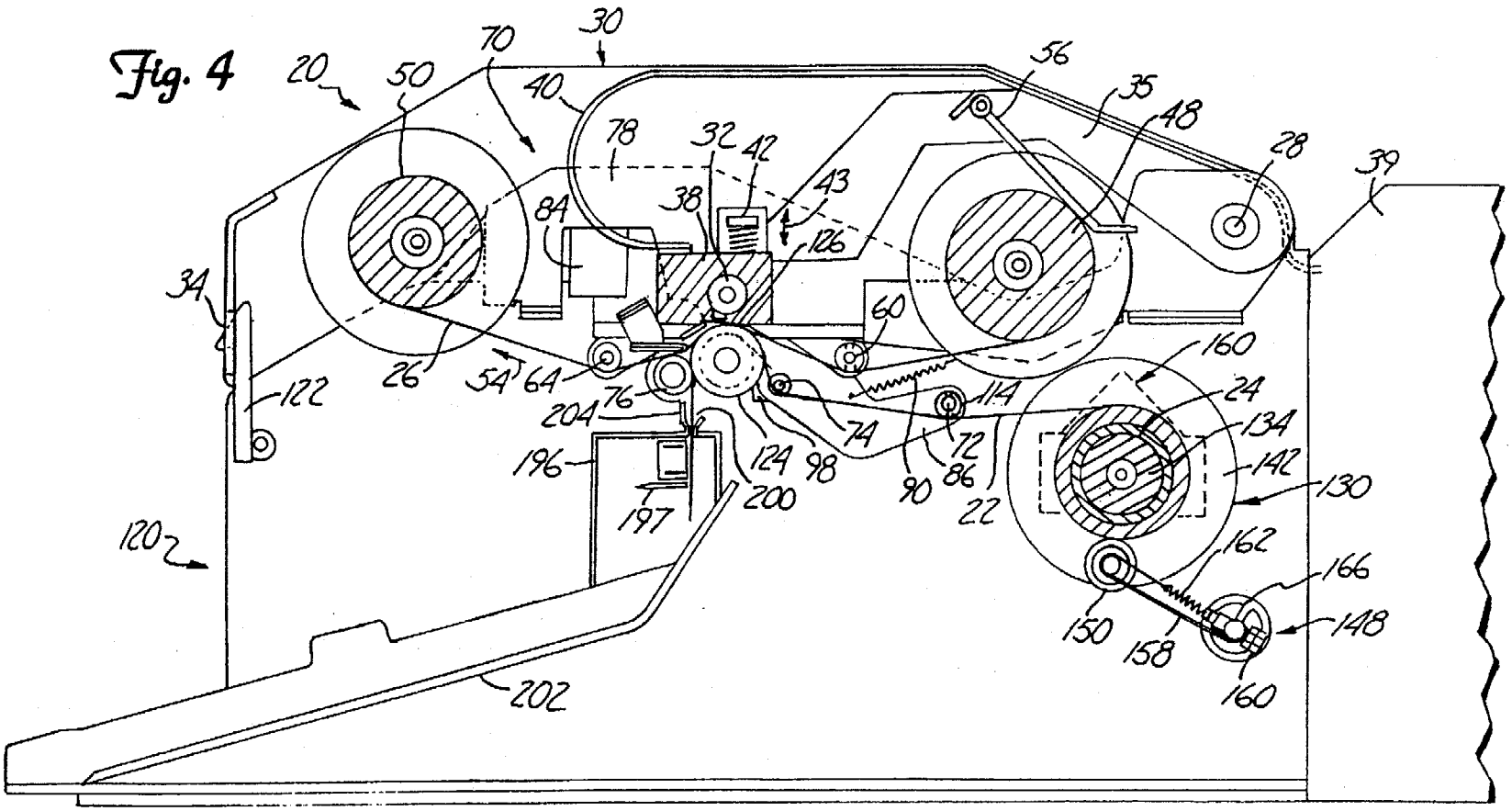
FIG. 4 is a side cross-sectional view of the printer with both clamshell structures latched down.

As shown in FIGS. 1–4, printer 20 has base portion 120 for printing media feed, intermediate portion 70 for guiding printing media 22, and upper portion 30 for donor media feed and print head 32. Upper portion 30 and intermediate portion 70 are both clamshell structures which pivot about hinge 28. FIGS. 1 and 2 depict printer 20 with upper portion 30 raised, and with intermediate portion 70 lowered into place over printing media 22. FIG. 1 includes donor media 26, while in FIG. 2 donor media 26 is absent. FIG. 3 depicts printer 20 with both upper portion 30 and intermediate portion 70 raised, and FIG. 4 depicts printer 20 with both upper portion 30 and intermediate portion 70 lowered. Upper portion 30 includes holes 34 which, when upper portion 30 is lowered, receive latches 122 on base portion 120 as shown in FIG. 4.

As will be further detailed below, printing occurs by print head 32 over platen 124. Generally speaking, platen 124 is rotated to transport printing media 22. Printing media 22 is generally paper, and will generally be heat sensitive paper when donor media 26 is absent. Donor media 26 is generally a thermally responsive wax or ink-based ribbon which transfers an image to printing media 22 when heated. Donor media 26 may be provided in continuously alternative segments of four-color donor media, with each pass of the image being printed with a different color from the donor media when full color printing is desired. Donor media 26 may be present or absent between printing media 22 and print head 32, and is primarily driven by takeup spool 50.

Thermal print head 32 is located on upper portion 30. As can be seen in FIG. 4, closing printer 20 places print head 32 immediate above top surface 126 of platen 124. Central support arm 35 (see FIGS. 1 and 2) is provided to stabilize and adequately support print head 32 and donor media transport system 46 on upper clamshell structure 30 for pivoting about hinge 28.

Thermal print head 32 includes linear array 36 of 7,168 individual thermal heating elements (not individually shown) extending across a 12-inch (303 millimeter) span. This placement of heating elements is equivalent to about 600 heating elements per inch, which in pan determines the resolution capability of printer 20. As shown in FIGS. 3 and 4, upper portion 30 houses computer circuitry 38 associated with controlling print head 32, while further computer circuitry is housed in rear portion 39. Through proper data manipulation and control of heating elements, the clarity provided by print head 32 can be increased equivalent to 1200 dpi or higher. The apparatus for controlling signals to and operation of thermal print head 32 is further described in U.S. patent application Ser. No. 08/298,936 filed 31 Aug. 1994, entitled "Method And Apparatus For Controlling A Thermal Print Head", and assigned to the assignee of the present invention, which is incorporated herein by reference. Flex circuit 40 carries electrical signals between rear portion 39, computer circuitry 38 and, print head 32 to individually control heating elements.

Print head 32 has automatic support system 42 (shown in part). Automatic support system 42 is regulated by software to lower and raise print head 32 a small distance, shown by arrows 43 in FIGS. 3 and 4. Print head 32 is lowered against platen 124 only when the upper clamshell 30 is closed and during printing. Automatic support system 42 can be programmed to adjust the distance between print head 32 and top surface 126 of platen 124 based on the thickness or type of printing media 22, the thickness or type of donor media 26, as well as the presence or absence of donor media 26. In this way, print head 32 can be properly distanced from the thermally responsive media in all print modes. Outrigger support structure 44 is pivotally connected on hinge 28 for further support of the print head 32 and automatic support system 42 about hinge 28. Workers skilled in the art will appreciate that numerous acceptable variations exist for adequately supporting print head 32 over platen 124.

Donor media transport system 46 includes donor media supply spool 48 and donor media takeup spool 50, with donor media 26 optionally running therebetween. Donor motor drive 52 is located adjacent takeup spool 50 (see FIG. 2) for rotating takeup spool 50, such that donor media 26 travels in the direction shown by arrows 54 in FIGS. 1, 3 and 4. Two sliders 56, 58 are spring mounted against donor media 26 on donor media supply spool 48, and function as a brake to tension donor media 26 across print head 32. Cleaning rod 60 is provided to clean the surface of donor media 26, such as with felt brash covering 62. As shown in FIG. 4, when printer 20 is closed, positioning rod 64 and cleaning rod 60 are located beneath print head 32 and beneath top surface 126 of platen 124. This positioning properly guides donor media 26 for arc contact across platen 124, allowing a proper friction force to be transmitted from platen 124 through printing media 22 to donor media 26. Positioning rod 64 and donor cleaning rod 60 also ensure proper height alignment of donor media 26 in relation to platen 124 and print head 32.

Drive and tensioning forces are placed on donor media 26 by platen 124, by print head 32, by takeup spool 50 and by sliders 56, 58. These various structures allow donor media 26 to be carried with printing media 22 when desired (i.e., forming no-slip contact with printing media 22, during donor printing), or alternatively, to be carried independent of printing media 22 when desired. (i.e., insubstantial contact with printing media 22, during changing of donor media colors and/or reversing of an image on printing media 22 past print head 32). Separation edges 66, 68 (see FIGS. 1–3), positioned on either side of print head 32, ensure proper removal of donor media 26 from thermal print head 32.

As will be understood by workers skilled in the art, exact length/width positioning of printing media 22 is more critical than exact length/width positioning of donor media 26.

Figure 5:
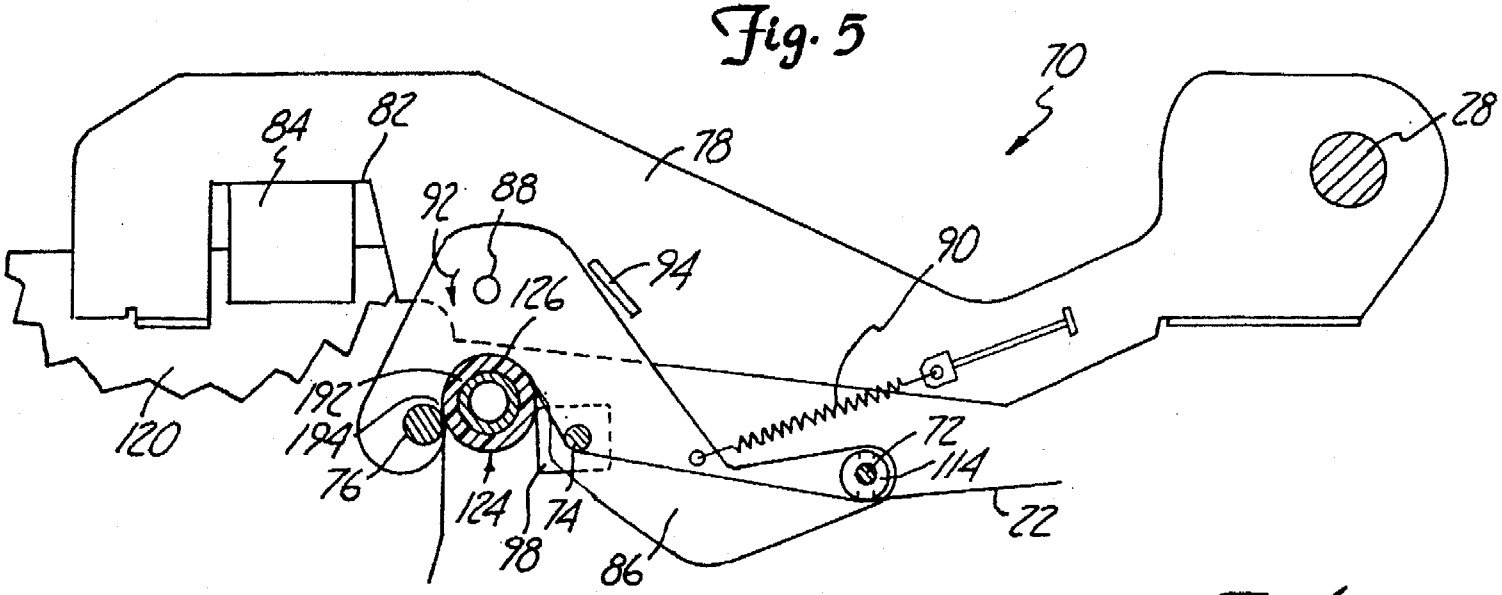
FIG. 5 is an enlarged cross-sectional side view of the intermediate clamshell structure of the printing media guide placed over the platen.

Intermediate portion 70 pivots about hinge 28 and includes cleaning rod 72, guide bar 74 and nip roller 76. Workers skilled in the art will appreciate that the connection with hinge 28 can be made with one or more detent positions. In this way intermediate portion 70 may have several resting locations along its clamshell rotation. A cross-section side view of the intermediate clamshell portion 70 is best shown in FIG. 5. While FIG. 5 shows only one support arm 78, it is to be understood that other support arm 80 (shown in FIG. 1) has a substantially corresponding structure.

Support arm 78 80 pivots on hinge 28. Notch 82 is located to correspond to block 84 on the side of printer base 120, such that support arm 78 has a set stop position when closed. Support arm 78 has pivot plate 86 pivotally attached to support arm 78 through pivot point 88. Tension spring 90 also connects pivot plate 86 to support arm 78. Tension spring 90 places a rotational force on pivot plate 86 relative to support arm 78 tending to rotate pivot plate 86 in a clockwise direction as shown by arrow 92 in FIGS. 3 and 5. Support arm 78 may include stop 94 which prevents tension spring 90 from fully contracting and provides a resting position for pivot plate 86.

The relative lengths and angles between hinge 28, cleaning bar 72, guide bar 74, nip roller 76, pivot point 88, tension spring 90 and platen 124 are important in determining the exact positional and force relationships between these various components. Workers skilled in the an will accordingly appreciate that these lengths and angles may be adjusted or modified as needed for their particular situation.

Cleaning rod 72, guide bar 74, and nip roller 76 are all positioned parallel to each other between opposing pivot plates 86. By closely maintaining and tolerancing this parallelism, particularly between guide bar 74 and nip roller 76, when nip roller 76 takes its positioning off platen 124, guide bar 74 will be as close as possible to parallel to platen 124 and print head 32. Cleaning rod 72, guide bar 74 and nip roller 76 are preferably closely toleranced from stainless steel to avoid any bending or non-circularity.

Nip roller 76 is positioned such that there is an interference between nip roller 76 and platen 124 during lowering of intermediate clamshell portion 70. Thus, in order to complete the downward movement of support arm 78, pivot plate 86 must be rotated and biased against tension spring 90. As support arm 78 is lowered for initial contact between nip roller 76 and platen 124, the rotation force from tension spring 90 tends to bias against further lowering of support arm 78. Support arm 78 may be further lowered, extending tension spring 90 to a point of full extension where the travel path of nip roller 76 is at its widest interference with the diameter of platen 124. As support arm 78 is pushed further downward, the interference between platen 124 and the travel path of nip roller 76 decreases, such that tension spring 90 is allowed to contract. In this configuration, tension spring 90 tends to place an increasing downward force on support arm 78, biasing support arm 78 into place against block 84. Thus, the spring force provided by tension spring 90 clamps the entire intermediate portion 70 downward.

Because pivot plates 86 are each independently suspended likewise on opposing support arms 78, 80, nip roller 76 always takes parallelism from the platen 124. Similarly, guide bar 74 always takes its parallelism from platen 124 through nip roller 76. This ensures that all the bars 72, 74, 76 are in parallel position with platen 124 and print head 32 when printing media 22 is being transported. Herein, the term printing media guide assembly is directed to an overall structure including both the intermediate clamshell portion 70, the upper clamshell portion 30, any parts mounted thereon, and in certain contexts, also the platen 124. The term pivot structure is directed to the collection of parts which include the support arms 86 and nip roller 76. Thus, the pivot structure comprises a subset of the printing media guide assembly.

Figure 6:
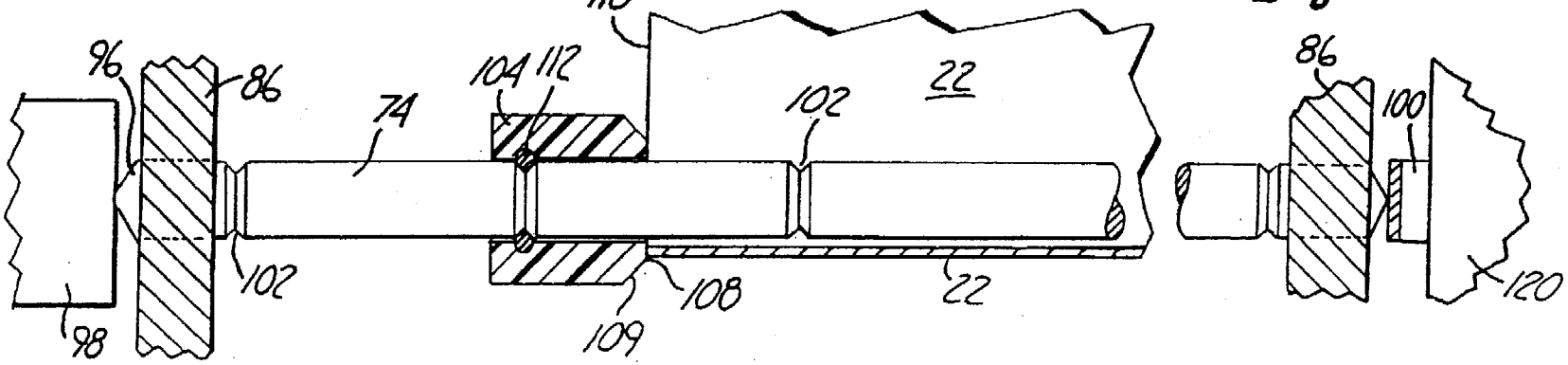
FIG. 6 is an enlarged plan view in partial cross-section of the guide bar of the present invention.

As best shown in FIG. 6, guide bar 74 is preferably rotationally mounted on pivot plates plate 86. Free rotation of guide bar 74 with printing media 22 helps to reduce the overall force from guide bar 74 on printing media 22, which increases the proportional force provided by guides 104, 106 and tends to make guides 104, 106 more effective. End 96 of guide bar 74 extends slightly beyond the surface of pivot plate 86 such that end 96 butts up against block 98 on base 120 when support arm 78 is lowered. Block 98 is made of DELRIN acetal to provide a proper wear resistant and slippery surface for end 96 of guide bar 74. On the opposite end of guide bar 74, leaf spring compresses 100 is provided such that guide bar 74 is always tensioned against block 98 with a constant force. The force provided by leaf spring 100 is preferably from three to five pounds. This butting up of guide bar 74 against block 98 ensures precise horizontal positioning of guide bar 74.

Guide bar 74 includes several circular indentations 102 along its periphery. Each of these indentations 102 is associated with a standard width of printing media 22. Guide bar 74 carries two guides 104, 106, to position the width of printing media 22. While only guide 104 is shown in FIG. 6, it is to be understood that guide 106 on the opposite end of guide bar 74 is substantially identical. Guide 104 is preferably made of DELRIN acetal and provides surface 108 for aligning edge 110 of the printing media 22. While surface 108 is shown perpendicular to the axis of guide 104, workers skilled in the art will appreciate that surface 108 need only be substantially perpendicular, and thus may be provided at an angle. In this way surface 108 places a force in the axial direction on printing media 22 whenever edge 110 of printing media 22 gets out of alignment. Guide 104 may have lead-in surface 109 to aid in positioning edge 110 of printing media 22 against surface 108.

C-shaped spring member 112 is located within guide 104. C-shaped spring 112 is tensioned such that guide 104 will hold any location along guide bar 74 and will further snap into discrete positions at circular indentations 102 associated with standard paper widths. C-shaped spring 112 is preferably made of an approximately 270° turn of spring steel.

Both cleaning rod 60 for donor media 26 and cleaning rod 72 for printing media 22 may be similarly constructed. Cleaning rods 60, 72 preferably have felt brush coverings 62, 114. Felt brush coverings 62, 114 wipe the top surface of donor media 26 and the top surface of printing media 22, respectively, prior to printing, both to clean the top surface and to dissipate static electricity from the respective media. Cleaning rods 60, 72 preferably do not rotate. As shown in FIG. 4, cleaning rod 72 should be positioned such that printing media 22 contacts cleaning rod 72 regardless of the amount of printing media 22 (i.e., the diameter on supply roll 24) on supply spool 130. Cleaning rod 60 is similarly contacted by donor media 26 regardless of the amount of donor media 26 left on donor media supply spool 48.

The location of cleaning rod 72, guide bar 74 and nip roller 76 in relation to the flow path of printing media 22 can best be seen in FIGS. 4 and 5. When the intermediate portion 70 is clamped down, guide bar 74 forces printing media 22 into a bend in excess of 45°, and preferably about 80° about guide bar 74. This bend increases the width-wise stiffness of printing media 22 at guide bar 74, so that it may be appropriately guided by guides 104, 106. The positioning of cleaning rod 72 assures that printing media 22 always has the same bend at guide bar 74 while printing, regardless of the amount of printing media 22 on supply spool 130. Guide bar 74 is positioned immediately adjacent platen 124, so as to have the positioning of printing media 22 occur as close as possible to the location where printing occurs. Additionally, guide bar 74 and nip roller 76 are positioned so as to bend or wrap printing media 22 about platen 124 when intermediate portion 70 is lowered into place. In this way, printing media 22 contacts platen 124 in excess of a 160° arc and preferably about a 200° arc. The transport force for printing media 22 is primarily provided by the rotation of platen 124, and this arc of contact is preferable to ensure no slippage between printing media 22 and platen 124. The accuracy with which drive motion is transmitted from platen 124 to printing media 22 is critical in generating a high quality, high resolution image, particularly in full color printing.

Figure 7:
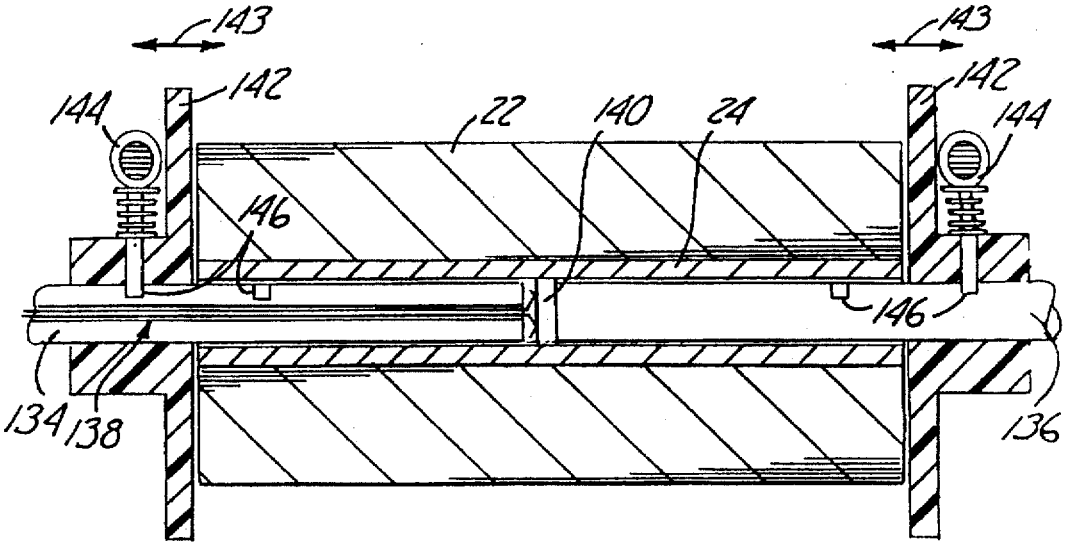
FIG. 7 is a cross-sectional elevational view of the printing media supply spool of the present invention.

Base portion 120 of printer 20 houses printing media supply spool 130, platen 124 and cutter 132. Printing media supply spool 130 supports printing media 22 in a centered position with relation to print head 32, regardless of the width of printing media 22. As shown in FIG. 7, printing media supply spool 130 includes two bars 134, 136 for insertion into 1 roll 24 of printing media 22. The outer diameter of bars 134, 136 is sized to match the inner diameter of roll 24, such that roll 24 will provide linear rigidity between bars 134, 136 when bars 134, 136 are inserted into roll 24. Workers skilled in the art will appreciate that the inner and outer diameter contact can be designed to have bars 134, 136 either rotate or remain stationary while roll 24 rotates. However, it is preferred that friction contact between bars 134, 136 and roll 24 be such that rotation of bars 134, 136 (for reversing an image past print head 32 during full color printing) will rotate roll 24. Alternatively, bars 134, 136 or side guides 142 may be manufactured with male protrusions for mating with female notches on roll 24, to provide positive rotational locking between bars 134, 136 and roll 24.

Bar 134 has read/write circuit 138 extending therethrough to contact centrally located profiler chip 140 in roll 24. Profiler chip 140 may retain information such as the thermal characteristics of printing media 22, the thickness of printing media 22 and the amount in printing media 22 remaining on supply roll 24. This information may then be read by read/write circuit 138 to properly configure and drive print head 32 and platen 124. Because bar 134 extends to the center of roll 24, read/write circuit 138 is properly positioned regardless of the width of printing media 22 or roll 24. It should further be noted that read/write circuit 138 remains positioned against profiler chip 140 to perform both reading and writing functions as necessary during rotation of roll 24. Workers skilled in the art will appreciate that read/write circuit 138 may be configured as desired, including extending through both bars 134, 136, to make appropriate contact with profiler chip 140.

Each bar 134, 136 supports one side guide 142 which contacts the edge of printing media roll 24. As illustrated by arrows 143 in FIG. 7, side guides 142 are moveable in an axial direction on bars 134, 136. Each side guide 142 has spring plunger 144 which can be positioned in any of several recesses 146 on bars 134, 136. Recesses 146 are provided in bars 134, 136 in positions associated with standard printing media widths. Side guides 142 are thus able to accommodate any width of printing media (where spring plunger 144 does not insert into any recess 146), and further have set positions associated with standard printing media widths (where spring plunger 144 is inserted into one of recesses 146).

Figure 8:
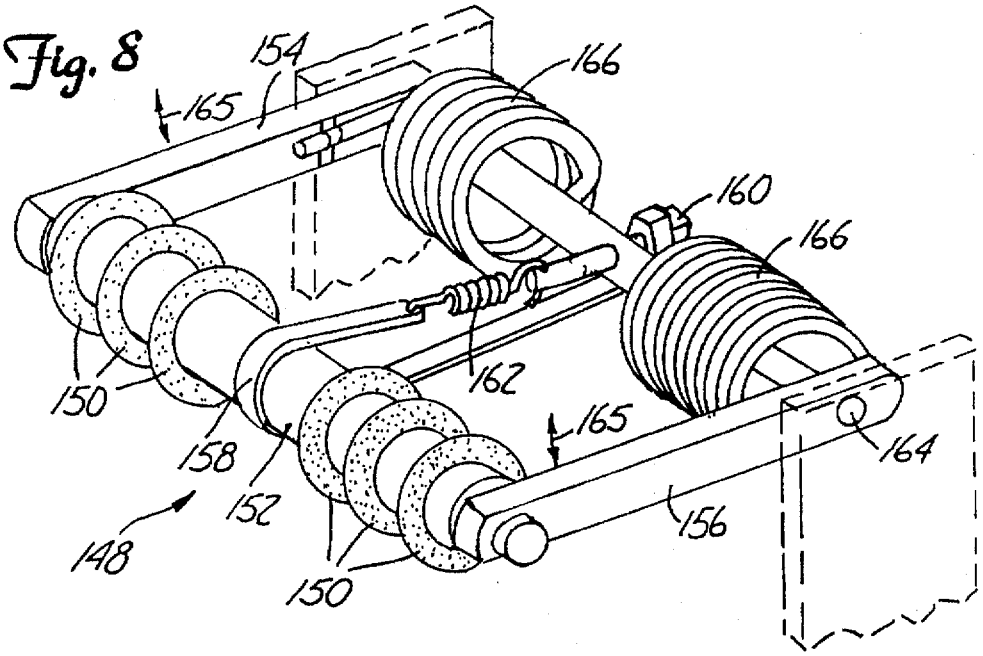
FIG. 8 is a perspective view of the braking system of the printing media supply spool of the present invention.

As best shown in FIGS. 3, 4 and 8, supply spool 130 is braked with brake 148. Brake 148 includes six o-rings 150 symmetrically spaced on idler shaft 152. Idler shaft 152 is rotationally mounted on idler arms 154, 156 which position idler shaft 152 such that o-rings 150 provide a friction contact between idler shaft 152 and printing media 22. In this way idler shaft 152 rotates with printing media 22 whenever printing media 22 is transport toward print head 32.

Rotation of idler shaft 152 is braked by brake belt 158. Brake belt 158 may be a coarse woven fabric to provide adequate friction on rotating idler shaft 152. For accurately controlling the tension on brake belt 158, screw 160 and spring 162 attaches to brake belt 158. Turning of screw 160 tightens or loosens brake belt 158. Spring 162 extends as tension on brake belt 158 is tightened, providing a higher degree of tension control. Either the length of spring 162 (i.e., how much spring 162 has been extended) or the position of screw 160 can be visually checked to determine how much tension has been placed on brake belt 158. Workers skilled in the art will recognize that numerous other ways exist to tension brake belt 158, including having both ends of brake belt 158 attached to sprint spring 162 and/or screw 160. Similarly, numerous other ways exist for a constant brake on idler shaft 152. Because idler shaft 152 is always positioned at the exterior of supply spool 130 (i.e., on printing media 22), the tension force placed on printing media 22 by brake 148 is constant regardless of the amount of printing media remaining (i.e., regardless of the diameter of printing media 22 on roll 24).

As shown by arrows 165 in FIG. 8, idler arms 154, 156 rotate about pivot 164 to maintain idler shaft 152 with proper normal force against supply spool 130. Torsion springs 166 ensure that brake 148 maintains a satisfactory normal force against the exterior surface of supply spool 130. While it is not necessary to maintain a constant normal force between idler shaft 152 and supply spool 130 for brake 148 to provide constant drag/tension, providing a relatively constant normal force ensures proper friction contact between o-rings 150 and printing media 22. Workers skilled in the art will appreciate that a relatively constant normal force can be provided in at least four ways: by using torsion springs 166 with enough turns that the expansion caused by pivoting of brake 148 produces an insubstantial change in torsion force; by biasing multiple torsion springs against each other, by using a constant torsion spring arrangement, or by combating a decrease in torque from an expanding torsion spring against a change in the angle of engagement between supply spool 130 and idler shaft 152 as idler shaft 152 pivots about pivot point 88. Workers skilled in the art will further recognize that brake 148 can be oriented such that it substantially only brakes in one rotational direction of supply spool 130, and thus provides little or no braking force when printing media 22 is being reversed.

Figure 9:
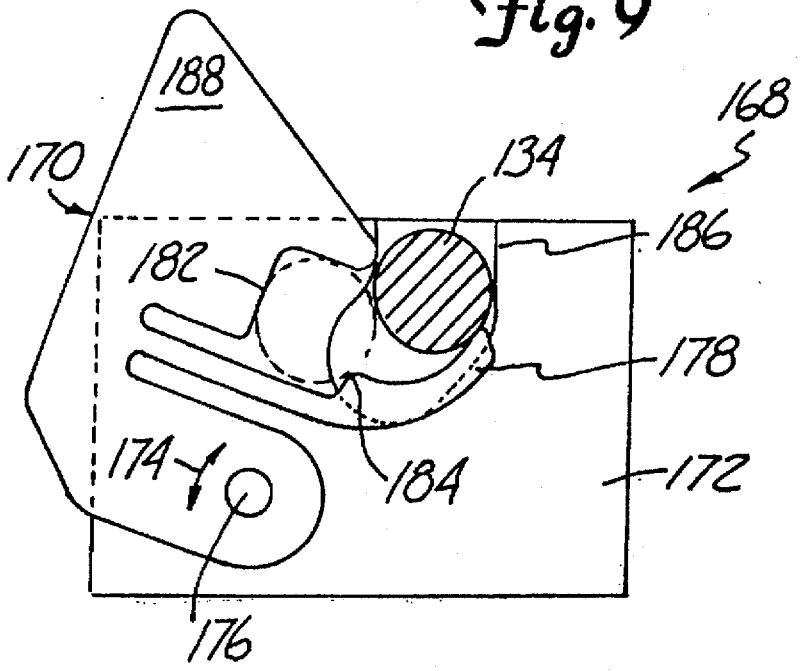
FIG. 9 is a side view of the latching mechanism for the printing media supply spool as the supply spool is pressed just to enter the channel block.
Figure 10:
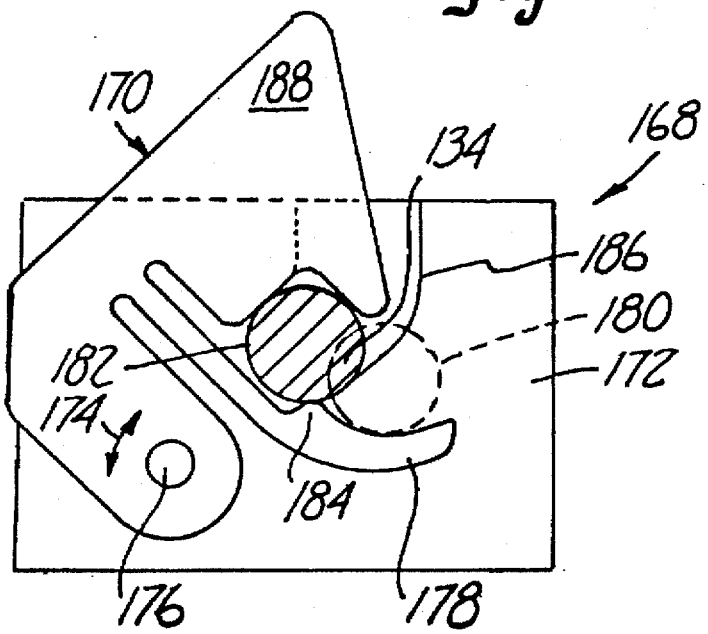
FIG. 10 is a side view of the latching mechanism for the supply spool in a latched position.

Clamping arrangement 168 for insertion and removal of supply spool 130 is best shown in FIGS. 9 and 10. While only one clamping arrangement 168 is shown and discussed, it is to be understood that printer 20 had a substantially similar clamping arrangement on the other side of supply spool 130. Clamp 168 includes latch portion 170 and channel block 172. Channel block 172 is fixedly mounted to base portion 120, in a position to hold supply spool bar 134, 136 (as shown dashed lines in FIGS. 3 and 4). As shown in FIG. 9 by arrow 174, latch portion 170 is rotationally mounted to channel block 172 at pivot point 176. Latch 170 includes spring arm 178, which is configured to receive bar 134 without bending in bar-releasing position 180 (as shown in FIG. 9, depicted in dashed line in FIG. 10) and bar-latching position 182 (depicted with dashed line in FIG. 9, as shown in FIG. 10). Latch 170 and spring arm 178 also define neck 184 separating bar-releasing position 180 and bar-latching position 182. By deflecting spring arm 178, neck 184 can be enlarged to allow bar 134 to pass between bar-releasing position 180 and bar-latching position 182. Channel 186 assures that downward pressure on bar 134 forces bar from bar-releasing position 180 past neck 184 and into bar-latching position 182. Latch 170 gives an audible "click" when spring arm 178 returns from deflection and bar 134 is correctly latched into place. Latch 170 is preferably made of an elastic plastic material such that spring arm 178 can be repeatedly deflected without breakage, and is also lightweight. Acetal has been found to be a suitable material both for latch 170 and for channel block 172. The length of supply spool bar 134, 136 is such that it extends through latch 170 and into channel 186 of channel block 172.

FIG. 9 shows clamping arrangement 168 as supply spool bar 134, 136 is just placed into clamping arrangement 168. Bar 134 is received in channel 186 of channel block 172 and in bar-releasing position 180 of latch 170. As supply spool bar 134, 136 is pressed downward through channel block 172, latch 170 is rotated and spring arm 178 is bent such that bar 134 proceeds through neck 184 and into bar-latching position 182. FIG. 10 shows clamping arrangement 168 with bar 134 in bar-latching position 182. In this way, bar 134 latches itself within clamping arrangement 168.

In the latched orientation shown in FIG. 10, channel 186 prevents bar 134 from rotational travel (i.e., travel about a circle around pivot point 176). Latch 170 provides a flat surface preventing bar 134 from radial travel (i.e., travel about a line through pivot point 176, or up channel 186), and neither rotational nor radial force on bar 134 tends to rotate latch 170. In this way, bar 134 is securely latched in place, with no tendency to become unlatched unless latch 170 is rotated about pivot point 176 by an exterior force. Latch 170 includes thumb catch 188, allowing easy rotation of latch 170 backwards, forcing supply spool bar 134 up channel 186 and out of bar-latching position 182, thus releasing bar 134. Workers skilled in the art will appreciate that channel block 172 and latch 170 can be somewhat modified in shape while still providing the same advantages.

It should be noted that while profiler chip 140, supply spool bars 134, 136, brake 148 and clamping arrangement 168 shown in FIGS. 7–10 have been described with reference to printing media supply, similar or identical structures may be incorporatated as desired for donor media supply and take-up. In particular, it may be beneficial to have a donor media profiler chip (not shown) to communicate such information as the thermal characteristics of donor media 26, the thickness of donor media 26, the amount of donor media 26 remaining on donor supply spool 48, the color profile of donor media 26 and the length/orientation of particular color segments on donor media 26.

Platen 124 provides the backing surface for thermal print head 32 as well as the primary, drive mechanism for printing media 22. Platen motor 190 (FIG. 2) is preferrably a stepper motor which rotates platen 124 at 2400 steps per inch of printing media 22. The rate of stepping platen motor 190 is related to the time necessary for thermal print head 32 to adequately heat desired locations on printing media 22, including the signalling times for the individual heating elements, the heating characteristics of the individual heating elements, and the thermal responsiveness of the thermally responsive media. In the preferred embodiment and while using full width printing media 22, platen motor 190 is stepped at an approximate rate of one step every 9 milliseconds, for an average printing media transport speed of around 3 inches per minute. Workers skilled in the art will recognize that the number of steps per inch and the stepping rate can be varied as necessary to produce the desired image on printing media 22.

When lowered into the latched configuration shown in FIG. 4, nip roller 76 is calibrated with tension spring 90 to press against platen 124 with 15 to 28 pounds of force. Nip roller 76 is mounted on pivot plate 86 to rotate freely, such that nip roller 76 rotates in no-slip friction contact with printing media 22 and platen 124. Platen 124 preferably has a surface layer 192 (see FIG. 5) made of a compressible elastomeric material such as ⅛th inch thick silicone rubber. The elastomeric material helps in providing a solid friction contact between platen 124 and printing media 22, as well as allowing for slight deformation.

Surface layer 192 is slightly depressed by the force provided by nip roller 76. The curvature of this slight depression causes printing media 22 to slightly accelerate as printing media 22 is being pulled through nip 194 between nip roller 76 and platen 124. The slight acceleration of printing media 22 helps to separate printing media 22 from donor media 26 and away from print head 32.

After proceeding over platen 124 past print head 32 and nip roller 76, printing media 22 proceeds to cutter 132. Cutter 132 has a cover 196 to restrict access to cutter blade 197, which operates underneath cover 196. Cutting motor (not shown) is provided to run cutter blade 197 across the surface of printing media 22 as desired to separate an image from the rest of supply roll 24. Workers skilled in the art will appreciate that various types of cutters will acceptably separate an image from the remainder of printing media 22. Cover 196 may be configured with tapered opening 200 to aid in threading a leading edge of printing media 22 into cutter 132. Tray 202 supports and guides printing media 22 carrying an image out of printer 20, providing the final output to a user.

For aligning an image for subsequent passes of additional color portions of donor media 26, optical sensor 204 (see FIGS. 3 and 4) and reverse motor 206 (see FIG. 2) are provided. Optical sensor 204 can detect the presence of a locating pattern on printing media 22, and thus the precise lengthwise orientation of the image can be known. Reverse motor 206 is provided to act on supply spool 130, to selectively rewind printing media 22 onto supply spool 130.

The operation of optical sensor 204 and reverse motor 206 are as follows. Prior to beginning printing a first color of a full color image, print head 32 lays down a locating pattern for optical sensor 204. After the image is fully printed in the first color, reverse motor 206 is operated to return the image upstream of print head 32. At the same time, donor motor drive 52 advances donor media 26 to a next color. After reversal, the image on printing media 22 is again stepped past print head 32 by platen motor 190 until optical sensor 204 detects the locating pattern, identifying the precise starting lengthwise orientation of the image for the next color. The reversal procedure may be repeated until all colors necessary for a full color image are printed.

It should be noted that platen 124 may not be manufacturable to be perfectly circular, and may be further deformed out-of-round during use of printer 20. Any such non-circularity will cause printing media 22 to be transported at varying step sizes based on the radius of platen 124 at any particular rotational orientation, which in turn causes imperfections in the image printed. Similarly, the drive system for platen 124, including motor 190 and any pulleys or timing belts associated therewith (not shown), may also contain slight errors preventing perfectly uniform stepping. These slight imperfections are almost imperceptible on single pass printing. However, in multiple pass printing (such as full color), the imperfections can occur at different locations of the various passes, and result in poor image quality. It is therefore important that platen 124, together with the drive system therefore have the same rotational orientation during each pass of a multiple pass image. During printing media reversal, platen 124 is preferably allowed to rotate backward with printing media 22 so the friction contact between platen 124 and printing media 22 may be maintained. This will help retain the image at the same location relative to the rotational orientation of platen 124. Workers skilled in the art will recognize that other methods can be employed to ensure the proper rotational orientation of platen 124, including rotating platen 124 and the drive system therefore to a particular position at the beginning of each printing pass.

With this reverse motor/optical sensor configuration, reverse motor 206 does not need to be nearly as accurate as platen motor 190. Inaccuracies associated with reversing the direction of printing media 22 are avoided, as are cumulative errors from multiple rewinds. Workers skilled in the art will recognize that various alternative sensor configurations can be used to adequately determine the lengthwise position of the image.

The dual clamshell structure provides ease of access to the interior of printer 20, both for installing or removing printing media 22 and donor media 26 and for any maintenance of printer 20 that is required. Threading of printer 20 can be easily accomplished as follows. First, intermediate portion 70 and upper portion 30 are raised (see FIG. 3). Roll 24 of printing media 22 is placed onto both supply spool bars 134, 136, with side guides 142 positioned such that printing media 22 is centered relative to supply spool 130 (see FIG. 7). This supply spool 130 is then self-latched into place merely by pressing the assembly downward such that supply spool bars 134, 136 engage clamping arrangement 168 (see FIGS. 9 and 10). Printing media 22 is taken off the top of printing media supply spool 130, placed over platen 124 and fed through cutter 132. Intermediate portion 70 is lowered and self-latched into place, with nip roller 76 forming a secure friction contact between nip roller 76, printing media 22 and platen 124. Guides 104, 106 are positioned to assure that printing media 22 is precisely centered relative to platen 124. Donor media 26, if desired, is threaded between donor media supply spool 130 and donor media takeup spool 50. Now upper portion 30 may be pivoted downward and latched against base 120, as shown in FIG. 4, and printer 20 is ready for operation.

Although the present invention has been described with reference to preferred embodiments, workers skilled in the art will recognize that changes may be made in form and detail without departing from the spirit and scope of the invention. For instance, workers skilled in the art will recognize that numerous alternatives exist in supporting and arranging the various components such that they function according to the present invention.

What is claimed is:

1. A high-resolution thermal printer comprising:

a stationary print head having resolution of at least 300 dpi;

a platen opposed to the print head;

a printing media transport system for transporting printing media between the print head and the platen;

a printing media guide assembly comprising:

an upper clamshell structure pivotable to an open position to eliminate contact between a printing media guide and the printing media wherein the printing media guide and the printing media establish mutual contact when the upper clamshell structure is pivoted to a closed position;

first and second pivoting arms pivotally supported on an intermediate clamshell portion connected to the upper clamshell structure and pivoting about a pivot axis adjacent a longitudinal axis of the platen when the upper clamshell structure is at the closed position;

a nip roller supported by the first and second pivoting arms parallel to and adjacent the platen;

a guide bar placement block for positioning against a first end of the printing media guide; and a spring for positioning against a second end of a printing media guide bar, the guide bar placement block and the spring cooperating to ensure proper axial positioning of the printing media guide.

2. A high-resolution thermal printer comprising:

an elongate stationary thermally energized print head having a linear resolution of at least 300 dpi;

a platen opposed to the print head;

a printing media transport system for transporting a printing media between the print head and the platen; and a printing media guide assembly comprising:

an upper clamshell structure pivotable to an open position to eliminate contact between the printing media guide assembly and the printing media, wherein a portion of the printing media guide assembly and the printing media establish mutual contact when the upper clamshell structure is pivoted to a closed position;

first and second pivoting arms pivotally supported on an intermediate clamshell portion mechanically coupled to the upper clamshell structure and pivoting about a pivot axis adjacent a longitudinal axis of the platen when the upper clamshell structure is at the closed position; and a nip roller supported by the first and second pivoting arms parallel to and adjacent the platen.

3. The high-resolution printer of claim 2, further comprising:

a media guide bar supported by the first and second pivoting arms, the guide bar contacting the printing media.

4. The high resolution thermal printer of claim 3, wherein the nip roller and the media guide bar cooperate to wrap the printing media at least 200° about the platen so that the print head can releasably couple to a portion of the printing media intermediate the nip roller and media guide bar.

5. The high-resolution thermal printer of claim 3, wherein the guide bar is positionable to provide a bend in the printing media of at least 45° about the media guide bar and relative to a plane defined by an axis of the media guide bar, wherein at least one of the lateral edges of the printing media contact a portion of the media guide bar at the bend in the printing media.

6. The high resolution thermal printer of claim 5, wherein the guide bar contacts the printing media such that the bend in the printing media defines an angle of about 80° around the guide bar and guide bar axis.

7. The high resolution thermal printer of claim 2, wherein the first and second pivoting arms are biased to press the nip roller parallel to and against the platen only when the upper clamshell structure is at the closed position and wherein the print head engages the platen only when the thermal printer is operating to form images.

8. The high resolution thermal printer of claim 2, wherein the nip roller is biased toward the platen by a spring, wherein the nip roller contacts the platen at a secured position when the upper clamshell structure is at the closed station and the printing media guide bar is biased toward the platen at a side of the platen opposing the secured position.

9. The high-resolution thermal printer of claim 2, wherein the platen is surfaced with a layer of compressible material such that the nip roller causes only transient compression of the layer of compressible material and does not cause compression of the platen.

10. A printing media guide adapted for use with a high resolution thermal printer having a platen, the printing media guide comprising:

a printer base member having a platen disposed therein and rotatably supported at each end of said platen so that the platen can receive a portion of a printing media;

an upper clamshell structure pivotably mounted to the printer base member along an edge of the upper clamshell structure so that the upper clamshell structure manually articulates between a closed station and an open station;

a printing media guide pivot structure pivotably mounted to an intermediate clamshell portion which in turn pivotably couples to a common pivot axis shared with the upper clamshell structure and spaced from the platen and the printing media residing in the printer base member when the upper clamshell structure is disposed at the open station and in contact with the printing media when the upper clamshell structure is at the closed station, the printing media guide pivot structure further comprising;

first and second pivoting support arms supported on the intermediate clamshell portion so that as the upper clamshell structure is pivoting to the closed station about a pivot axis adjacent the platen the intermediate clamshell portion and the first and the second pivoting support arms approach opposing ends of the platen; and a nip roller supported by the first and second pivoting support arms and oriented parallel to and adjacent the platen when the upper clamshell structure is at the closed station.

11. The printing media guide of claim 10, further comprising: a cleaning rod supported by the first and second pivoting arms, the cleaning roll biased toward the printing media to continuously wipe the printing media as the printing media is fed through the printer.

12. The printing media guide of claim 10, further comprising an automatic support system means for engaging a print head and the platen only when the upper clamshell structure is at the closed station and the high resolution thermal printer is operating to form an image upon the printing media.

13. The printing media guide of claim 10, further comprising:

a media guide bar mechanically coupled to the printing media guide assembly and having an axis, the media guide bar disposed parallel to and adjacent the platen and the media guide bar contacting the printing media only when the upper clamshell structure is at the closed station; and a first and a second guide mounted on the guide bar, said first and second guide having a media contacting side substantially perpendicular to the guide bar longitudinal axis, the contacting side of each of said first and second guide contacting opposing lateral edges of the printing media to thereby align the printing media, the first and the second guide being movable in an axial direction on the guide bar to accommodate printing media of differing lateral dimension.

* * * * *